US005789996A

United States Patent [19]

Borodulin

[11] Patent Number: 5,789,996

[45] Date of Patent: Aug. 4, 1998

[54] N-WAY RF POWER COMBINER/DIVIDER

[75] Inventor: Dmitriy Borodulin, Quincy, Ill.

[73] Assignee: Harris Corporation, Melbourne, Fla.

[21] Appl. No.: 831,917

[22] Filed: Apr. 2, 1997

[51] Int. Cl.[6] ..... H01P 5/12; H01P 5/16

[52] U.S. Cl. ..... 333/117; 333/128; 333/26

[58] Field of Search ..... 333/100, 117, 333/118, 120, 123–125, 127, 128, 136, 26

[56] References Cited

U.S. PATENT DOCUMENTS 3,529,265 9/1970 Podell ..... 333/127
4,163,955 8/1979 Iden et al. ..... 333/127
4,992,761 2/1991 Seely et al. ..... 333/118
5,410,281 4/1995 Blum ..... 333/127

*Primary Examiner*—Paul Gensler
*Attorney, Agent, or Firm*—Tarolli, Sundheim, Covell, Tummino & Szabo

[57] ABSTRACT

A combiner/divider is provided which includes a common output/input port and a plurality of N input/output ports and a plurality of N isolation ports. A 90° phase shifter interconnects each of the N input/output ports with the common port. N transmission line balun transformers are provided with each interconnecting an input/output port with one of the N isolation ports. Each balun transformer serves as a two-way power splitter.

15 Claims, 5 Drawing Sheets

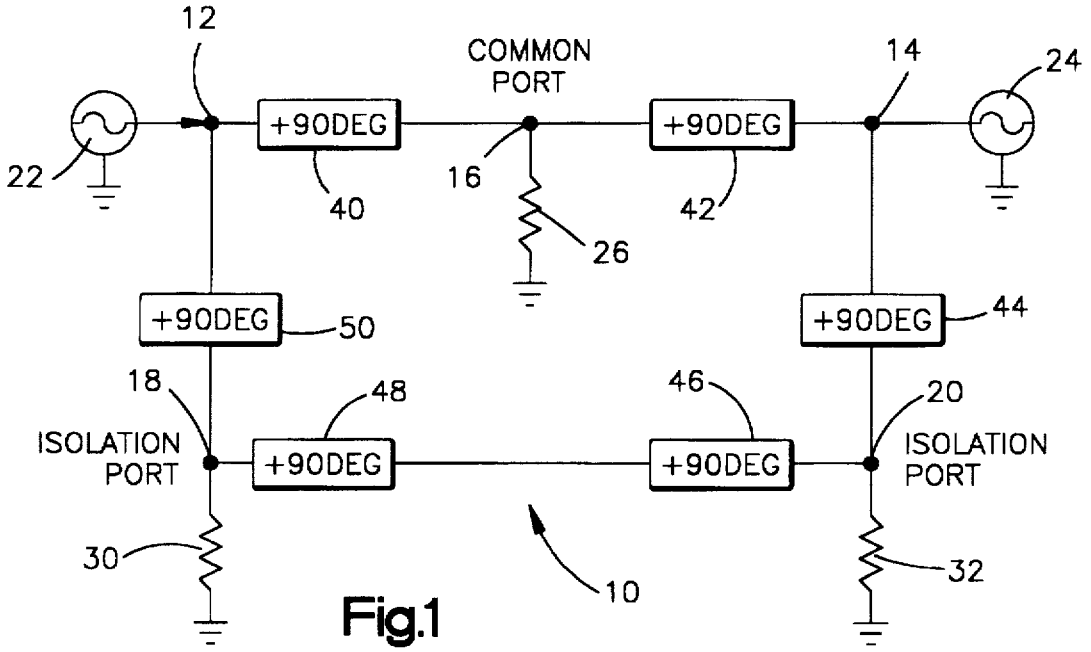
Fig.1
(PRIOR ART)
Fig.2
(PRIOR ART)
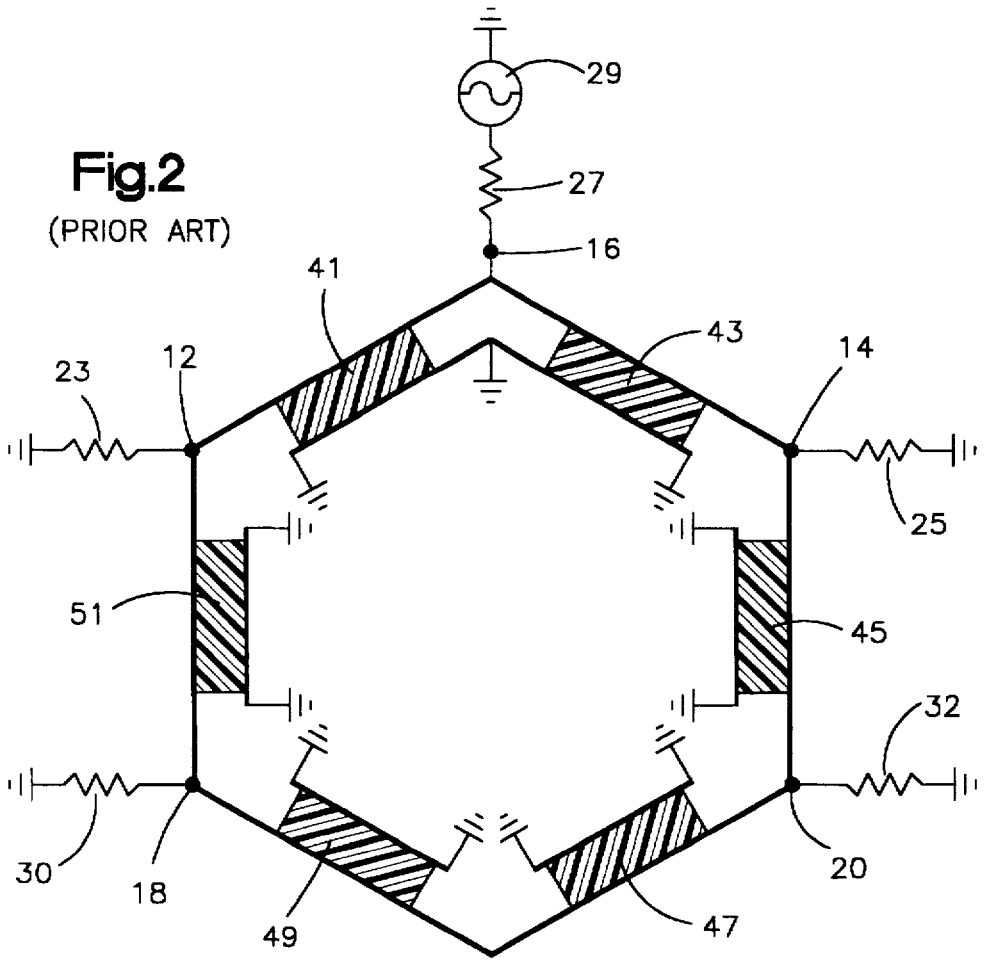

N-WAY RF POWER COMBINER/DIVIDER

FIELD OF THE INVENTION

This invention relates to the art of RF power combiner/divider circuits for use in combining or dividing RF signals.

BACKGROUND OF THE INVENTION

Combiner/dividers are known in the art for combining or dividing (splitting) electrical signals. For example, a RF signal generator may produce a radio frequency signal at a low power level and it may be desired that the signal be boosted in power to a much higher level. It is common to divide the RF signal and apply the divided signals to several paths each of which includes a power amplifier for increasing the amplitude of the signal. Conversely, RF signals which have been amplified may be combined and supplied to a RF load.

Combiner/dividers capable of performing these functions are known in the art. For example, the U.S. Pat. No. 4,163,955 to F. W. Iden et al. discloses a N-way power combiner/divider which is known as the Gysel combiner/divider. An example of a Gysel combiner may take the form of a two-way hybrid ring combiner. Such a combiner is disclosed in FIGS. 1 and 2 herein. This combiner, as will be discussed in greater detail hereinafter, includes six 90° phase shifting sections, two coherent RF power sources, and two isolation resistors. Two RF signals are respectively applied to two input ports to cause RF signals to propagate through the phase shifting sections and combine at a common port. The signals arrive at the common port with the same phase shift of 90°.

The Gysel type combiner/divider structures shown in FIGS. 1 and 2 employ six 90° phase shifting sections or branches. A modified prior art form of these Gysel structures is shown in FIGS. 3 and 4 including only four phase shifting sections to provide a simpler structure and which exhibits a greater frequency band. This structure, as will be described in greater detail hereinafter, includes one phase shifting section that shifts the phase by −90° instead of shifting the phase by +90° as in the case of the other three phase shifting branches. This structure is simpler than that as shown in FIGS. 1 and 2 in that it also has only a single isolation resistor. A disadvantage of the modified Gysel device of FIGS. 3 and 4 is the non-symmetry of its structure. Due to the frequency dependent amplitude response of the reversed transmission line (the −90° phase shifting branch), the power sources need to provide different power levels for an optimal performance.

SUMMARY OF THE INVENTION

It is an object to provide an improved combiner/divider circuit exhibiting greater symmetry and increased frequency range.

In accordance with one aspect of the present invention, there is provided a N-way RF power combiner/divider including a common output/input port and a plurality of N input/output ports and a plurality of N isolation ports. A 90° phase shifting transmission line interconnects each of the N input/output ports with the common port. N transmission line balun transformers are provided. Each transformer interconnects one of the input/output ports with one of the isolation ports.

In accordance with another aspect of the present invention, there is provided a N-way RF power combiner/divider including a common output/input port and a plurality of N input/output ports and a plurality of N isolation ports. A 90° phase shifting transmission line interconnects each of the N input/output ports with the common port. N two-way power splitters are provided. Each splitter has a +90° phase shift output and a −90° phase shift output with the +90° phase shift output of one splitter being connected in common with the −90° phase shift output of another splitter. This common connection is also common to one of the isolation ports.

BRIEF DESCRIPTION OF THE DRAWINGS

The foregoing and other features of the invention will become more readily apparent from the following description of the preferred embodiments of the invention as taken in conjunction with the accompanying drawings which are a part hereof and wherein:

FIG. 1 is a schematic-block diagram illustration of a prior art combiner/divider operating as a combiner;

FIG. 2 is a schematic illustration of a transmission line implementation of the combiner/divider of FIG. 1 but illustrated as a divider;

DESCRIPTION OF PREFERRED EMBODIMENTS

Figure 3:
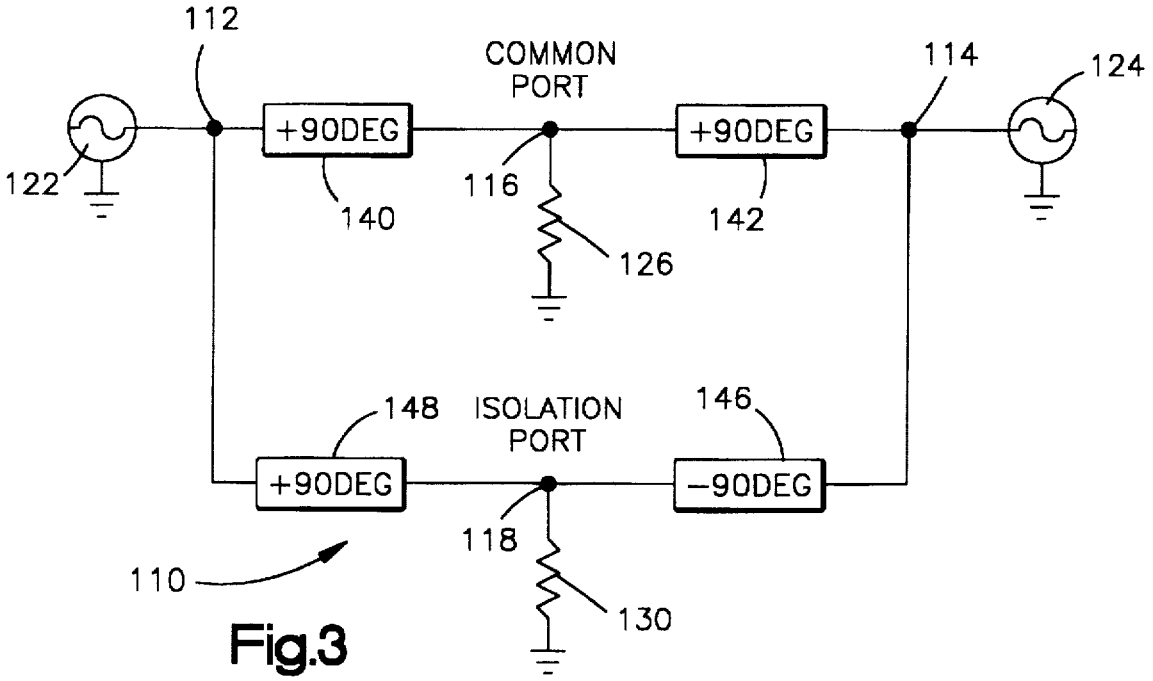
Fig.3 (PRIOR ART)
FIG. 3 is a schematic-block diagram illustration of a prior art modification of the combiner/divider in FIG. 1.

Before describing the preferred embodiments of FIGS. 5–9, reference is first made to a discussion of the prior art illustrated in FIGS. 1–4.

FIG. 1 illustrates a prior art combiner/divider 10 illustrated as a combiner. This is a hybrid ring that is sometimes known as a Gysel combiner and is described in the U.S. Pat. No. 4,163,955 to Iden. As shown in the block diagram of FIG. 1, the combiner is illustrated as a two-way combiner having six 90° phase shifting sections arranged in a hexagon. The combiner includes two input/output ports 12 and 14, a common output/input port 16, and a pair of isolation ports 18 and 20. A RF power source 22 is connected to the input/output port 12 which serves as an input port for a combiner implementation. Similarly, a RF power source 24 is connected to the input/output port 14 serving as an input port. The common port 16 serves as an output port and is connected to ground by way of a common load resistor 26. Isolation ports 18 and 20 are connected to ground by way of isolation loads 30 and 32. The six branches of the combiner each include a +90° phase shifter. These branches include phase shifters 40, 42, 44, 46, 48, and 50, as shown.

The two RF power signals from sources 22 and 24 are coherent RF power sources and provide two signals which are applied to the input ports 12 and 14. These signals propagate through the phase shifters and combine at the output port. As seen, these signals arrive at the output port 16 with the same phase shift of +90°. Also, the propagation path of both signals from sources 22 and 24 to the isolation loads 30 and 32 shows that the signals will arrive at these ports out of phase. They subtract and since they were initially of equal amplitude and phase they entirely eliminate each other.

The two RF power sources 22 and 24 are isolated from each other. Thus, the RF signal from source 22 does not appear at input port 14 for source 24 and vice versa. This happens because the RF input signal from source 22 splits by two and propagates two opposite ways to reach input port 14. Also, the two branches of the signal propagating from source 24 arrive at port 12 out of phase and eliminate each other which results in entire isolation. This is an ideal case of frequency independent combiner structure. The actual structure takes the form as shown in FIG. 2.

FIG. 2 illustrates the hybrid ring of FIG. 1 as a divider and not as a combiner. This is done for the purposes of illustrating that the structures are essentially the same. Like components in FIGS. 1 and 2 are identified with like character references and only the differences will be described in detail. The divider of FIG. 2 include ports 12 and 14 acting as output ports instead of input ports and a common port 16 which serves in this case as an input port. Isolation ports 18 and 20 are connected through isolation resistors 30 and 32 to ground, as in the case of FIG. 1. However, the input sources 22 and 24 of FIG. 1 are replaced in FIG. 2 with load resistors 23 and 25. The common port 16 serves as an input port and is connected by way of resistor 27 to a single RF signal source 29. The divider or splitter structure in FIG. 2 is a transmission line implementation of the hybrid ring structure and as such includes six transmission line sections in place of the six phase shifting sections of FIG. 1. These are transmission line sections 41, 43, 45, 47, 49, and 51. These are well known in the art and for example, each may include a microstrip structure including a pair of conductor strips spaced from each other by an intermediate dielectric insulator. The inner conductor strips of these transmission lines are connected to electrical ground, as shown.

Each transmission line section has a length of ¼wavelength to provide a phase shift of +90°. This phase shift, however, takes place at only one frequency and the frequency range of such a hybrid structure is ten percent when the input VSWR is less than or equal to 1.1 to 1.

FIG. 3 illustrates a prior art modified hybrid ring combiner which has a greater frequency band than that of the two-way combiner shown in FIG. 1. As a two-way combiner, the combiner 110 of FIG. 3 includes two input ports 112 and 114 and a common output port 116 and a single isolation port 118. The common port is connected to ground by way of a load resistor 126 and the isolation port 118 is connected to ground by way of a single isolation load 130. The four phase shifting sections include phase shifters 140, 142, 146, and 148. Thus, only four phase shifters are employed instead of six as in FIG. 1. The significant difference is that one of the phase shifters provides a −90° phase shift instead of a +90° phase shift. It operates in the same fashion as that of the version in FIG. 1 but requires a simpler structure in the form of a square instead of a hexagon and employs only four phase shifters.

Figure 4:
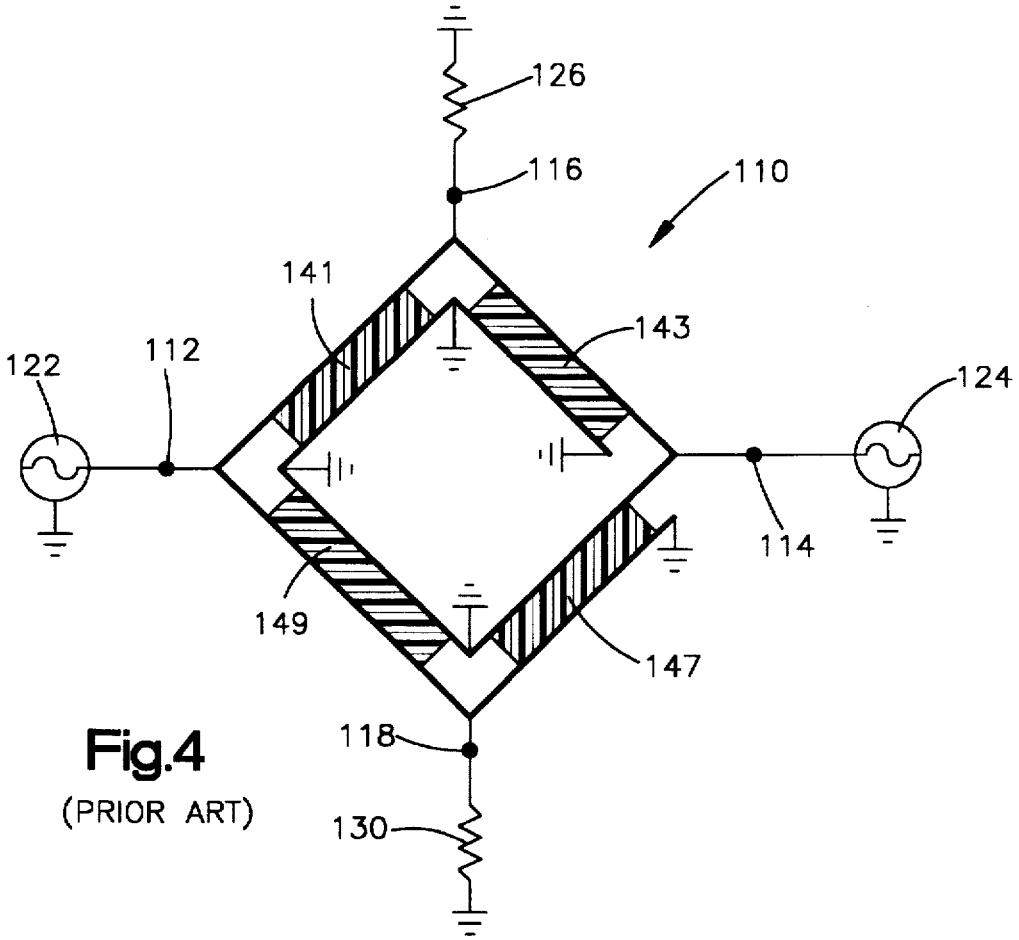
Fig.4 (PRIOR ART)
FIG. 4 is a circuit diagram illustration of a transmission line implementation of the prior art circuit of FIG. 3.

FIG. 4 illustrates a transmission line implementation of FIG. 3 as a combiner. This combiner 110 includes transmission lines in place of the phase shifters of FIG. 3. This includes transmission lines 141, 143, 147, and 149 in place of phase shifters 140, 142, 146, and 148 respectively of FIG. 3. It is to be noted, however, that transmission line 147 has its ends reversed connecting source 124 to ground instead of to the isolation port 118. This makes the transmission line 147 operate as a 180° phase shifter in addition to the 90° phase shift that is provided by its ¼ wavelength (each transmission line has a length of ¼ wavelength). Therefore, the total phase shift provided by transmission line 147 is 270° (or −90°). The difference from the hexagon structure of FIGS. 1 and 2 discussed hereinbefore is that the 180° phase shift works for all frequencies the same. It is not frequency dependent. Therefore, the bandwidth of this combiner is greater than that of versions in FIGS. 1 and 2. A disadvantage of the combiner of FIGS. 3 and 4 is the non-symmetry of its structure. Due to the frequency dependent amplitude response of such a reversed transmission line, the power sources have to provide different power for optimal performance.

Figure 5:
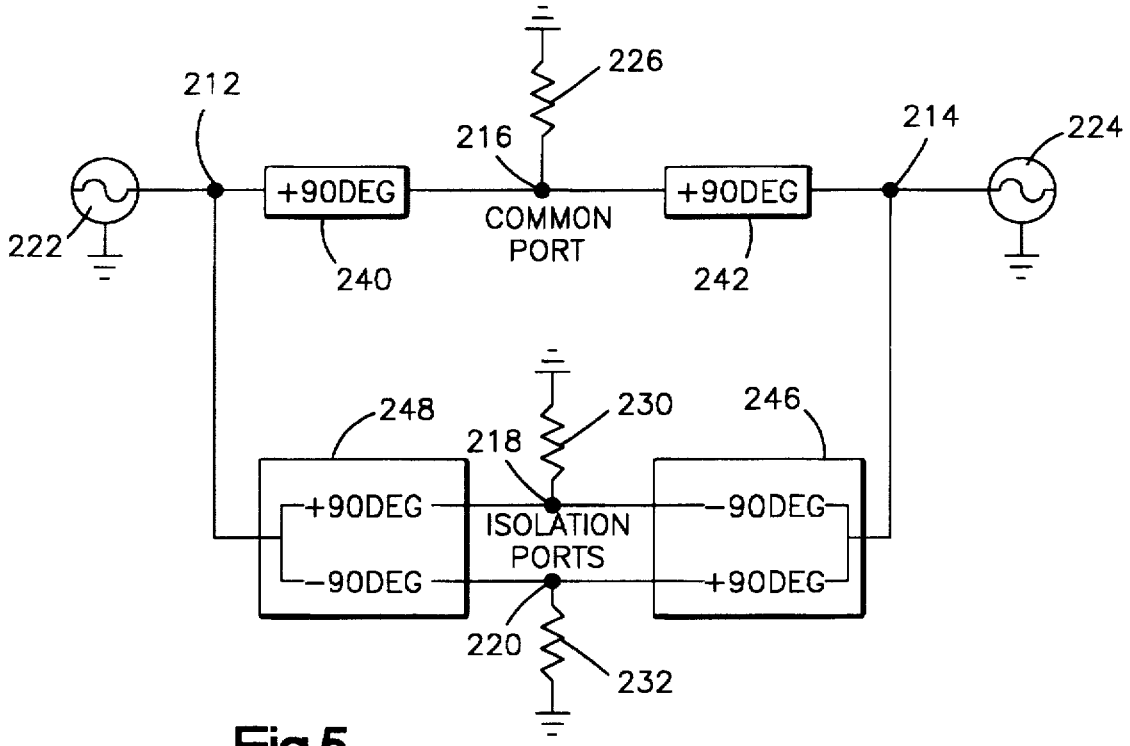
FIG. 5 is a schematic-block diagram illustration of one embodiment of the present invention.

Reference is now made to FIG. 5 which illustrates an embodiment of the present invention configured as a combiner. This is a special case that is presented as a two-way combiner (a more general case of a N-way combiner is illustrated herein at FIGS. 7 and 8). The two-way combiner of FIG. 5 includes a pair of input ports 212 and 214, a common output port 216 and a pair of isolation ports 218 and 220. Input ports 212 and 214 receive RF power signals from RF sources 222 and 224. The common port 216 is connected to ground by way of a load resistor 226. Isolation ports 218 and 220 are connected to ground by way of isolation loads 230 and 232. Input port 212 is connected to the common port 216 by way of a +90° phase shifter 240. Also, input port 214 is connected to the common port 216 by means of a +90° phase shifter 242.

Input port 212 is connected to the isolation ports 218 and 220 by means of a two-way power splitter 248. Power splitter 248 has a +90° phase shift output connected to isolation port 218 and a −90° phase shift output connected to isolation port 220. Similarly, input port 214 is connected to the isolation ports 218 and 220 by means of a two-way power splitter 246. This power splitter has a −90° output connected to the isolation port 218 and a +90° output connected to the isolation port 220. These two-way power splitters 246 and 248 may be referred to as balun transformers which equally distribute the input signals between the two isolation loads. This makes the structure of the combiner symmetrical and increases the working frequency range.

Figure 6:
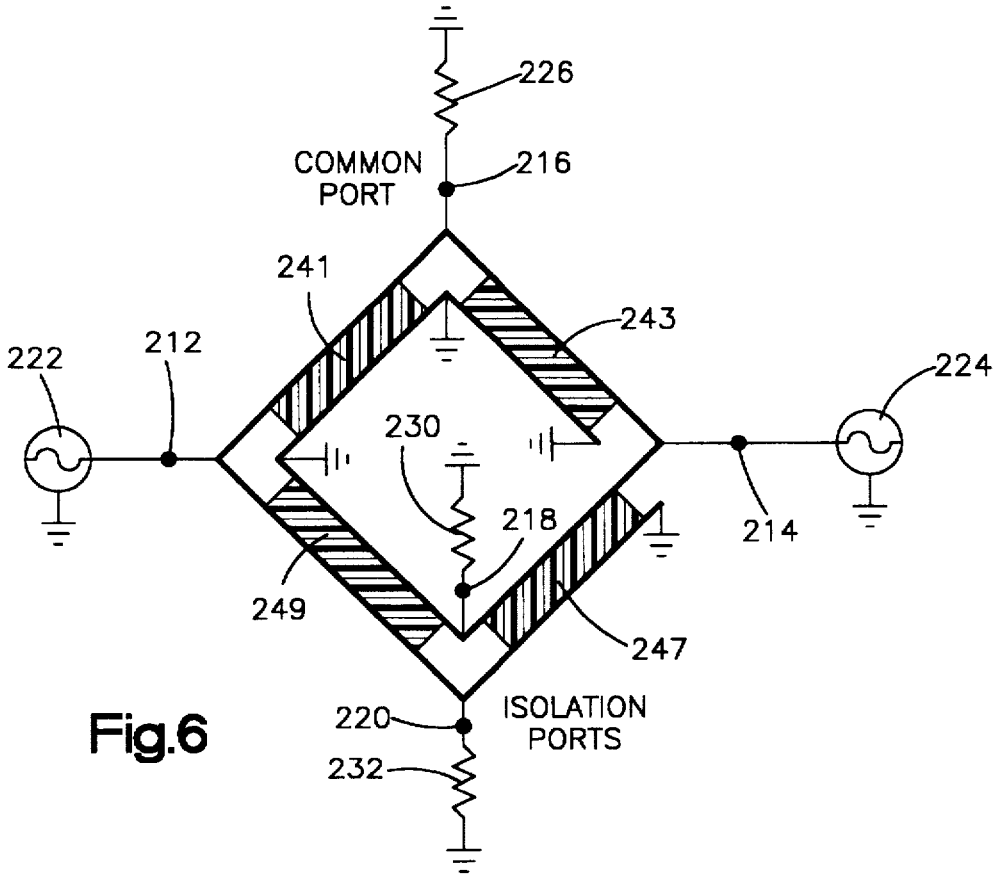
FIG. 6 is a circuit diagram illustrating a transmission line implementation of the embodiment of the invention shown in FIG. 5.

FIG. 6 is a circuit diagram illustrating a transmission line implementation of the embodiment shown in FIG. 5. In this implementation, the +90° phase shifters 240 and 242 are replaced with ¼ length transmission lines 241 and 243. Also, the two-way power splitters 246 and 248 of FIG. 5 are replaced by balun transformers 247 and 249. Note that the ends of the balun transformers are connected so as to provide the phase relationships as illustrated in FIG. 5.

Figure 7:
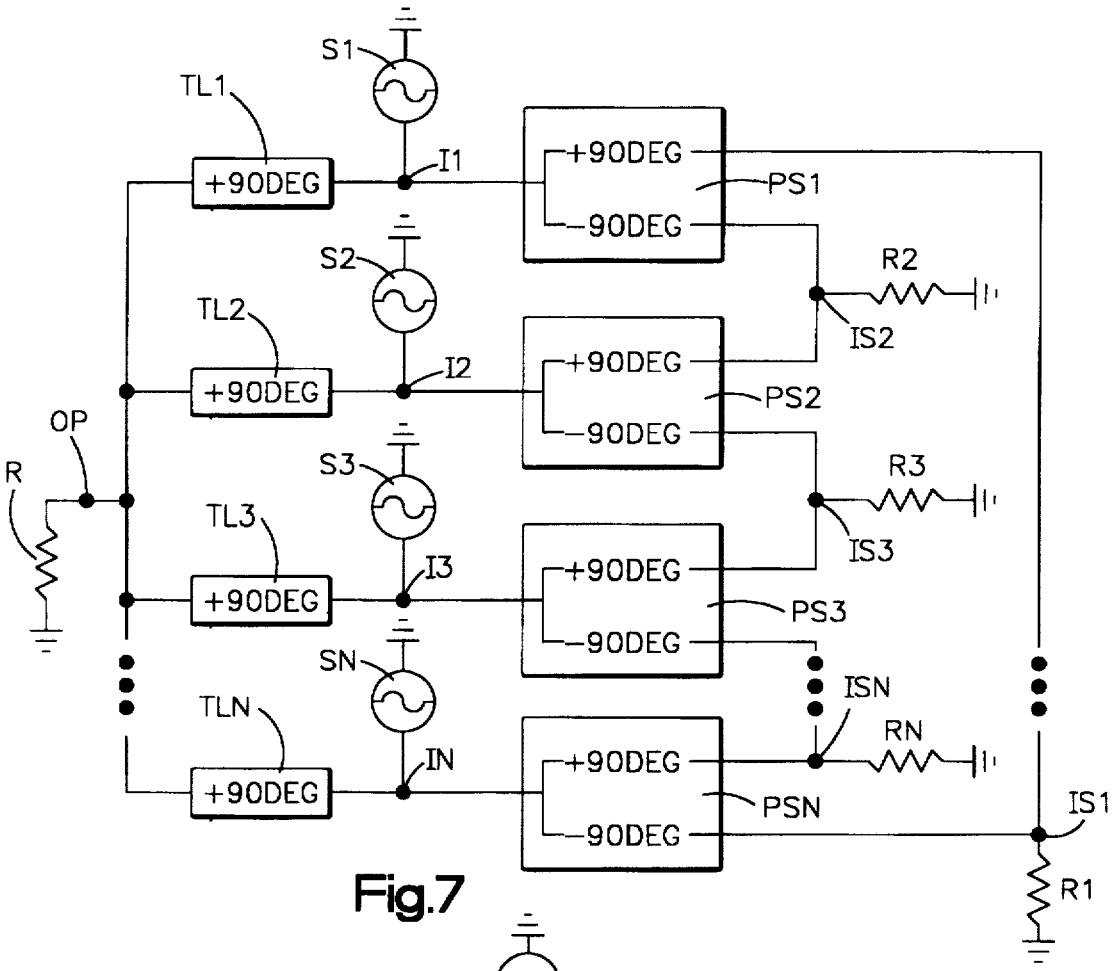
FIG. 7 is a schematic-block diagram illustration of a second embodiment of the present invention.
Figure 8:
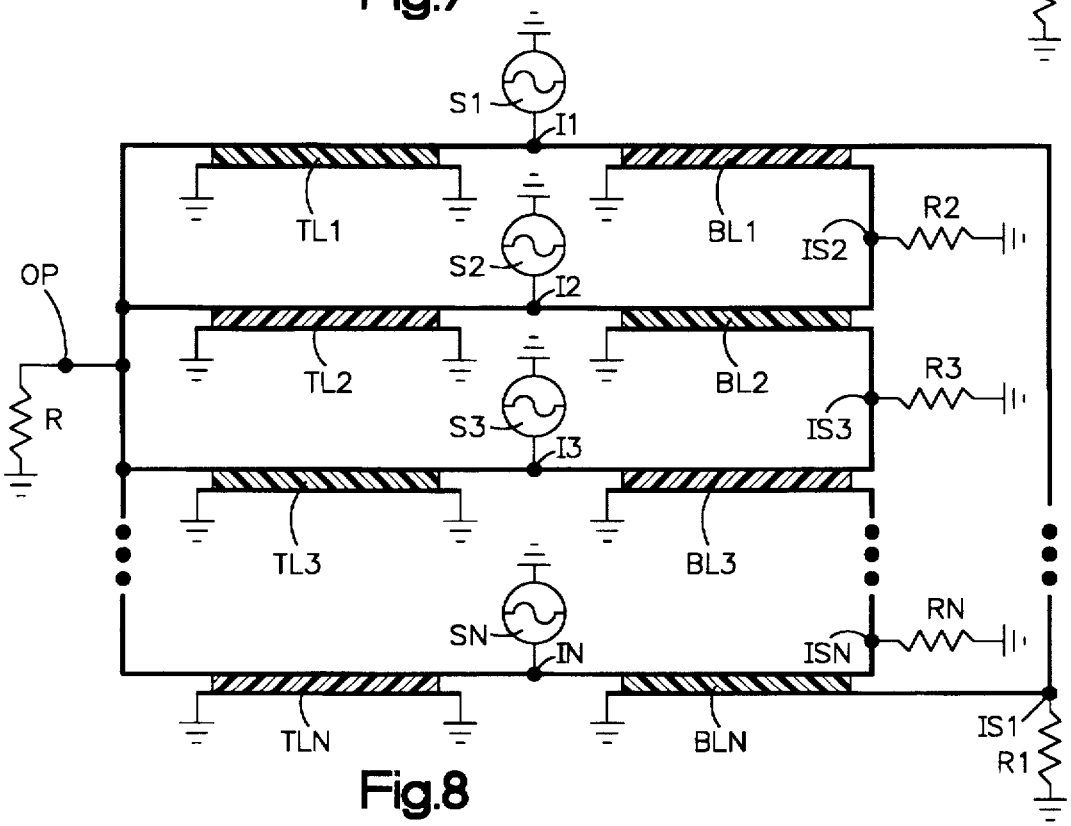
FIG. 8 is a circuit diagram illustration of a transmission line implementation of the embodiment shown in FIG. 7.

Reference is now made to FIGS. 7 and 8 which illustrate a more general version of the invention as a N-way power combiner. In FIG. 7, the combiner includes input ports I1, I2, I3 . . . IN connected to RF input sources S1, S2, S3... SN. The combiner includes a common output port OP. The common load resistor R is connected from port OP to ground. +90° phase shifter transmission lines TL1 through TLN are connected between the common output port OP and the input ports I1 through IN. Two-way power splitters PS1 through PSN are provided with one end of each being connected to one of the input ports I1 through IN. Each two-way power splitter has a +90° phase shift output and a −90° phase shift output. These outputs are connected to the isolation ports IS1 through ISN in the manner indicated. These ports in turn are connected to ground by way of isolation loads R1 through R(N). It is to be noted that the outputs of the power splitters PS1 through PSN are connected to the outputs of adjacent similar two-way power splitters in a manner to make the sum of their insertion phase equal to zero.

Reference is now made to FIG. 8. This is a transmission line implementation of the circuitry illustrated in FIG. 7. In the implementation of FIG. 8, it is noted that the transmission lines TL1 through TLN are illustrated as ¼ wavelength transmission lines and not merely as +90° phase shifters. Also, in FIG. 8, the power splitters PS1 through PSN of FIG. 7 are illustrated as transmission line balun transformers BL1, BL2, BL3.. .BLN. Note that this is a fully symmetrical structure permitting any number of RF matched sources to be combined and supplied to a single common load. This structure provides a shortened length compared to the hybrid ring structures of FIGS. 1 and 2. The symmetry of the structure allows the combiner to work at a wider frequency range.

Figure 9:
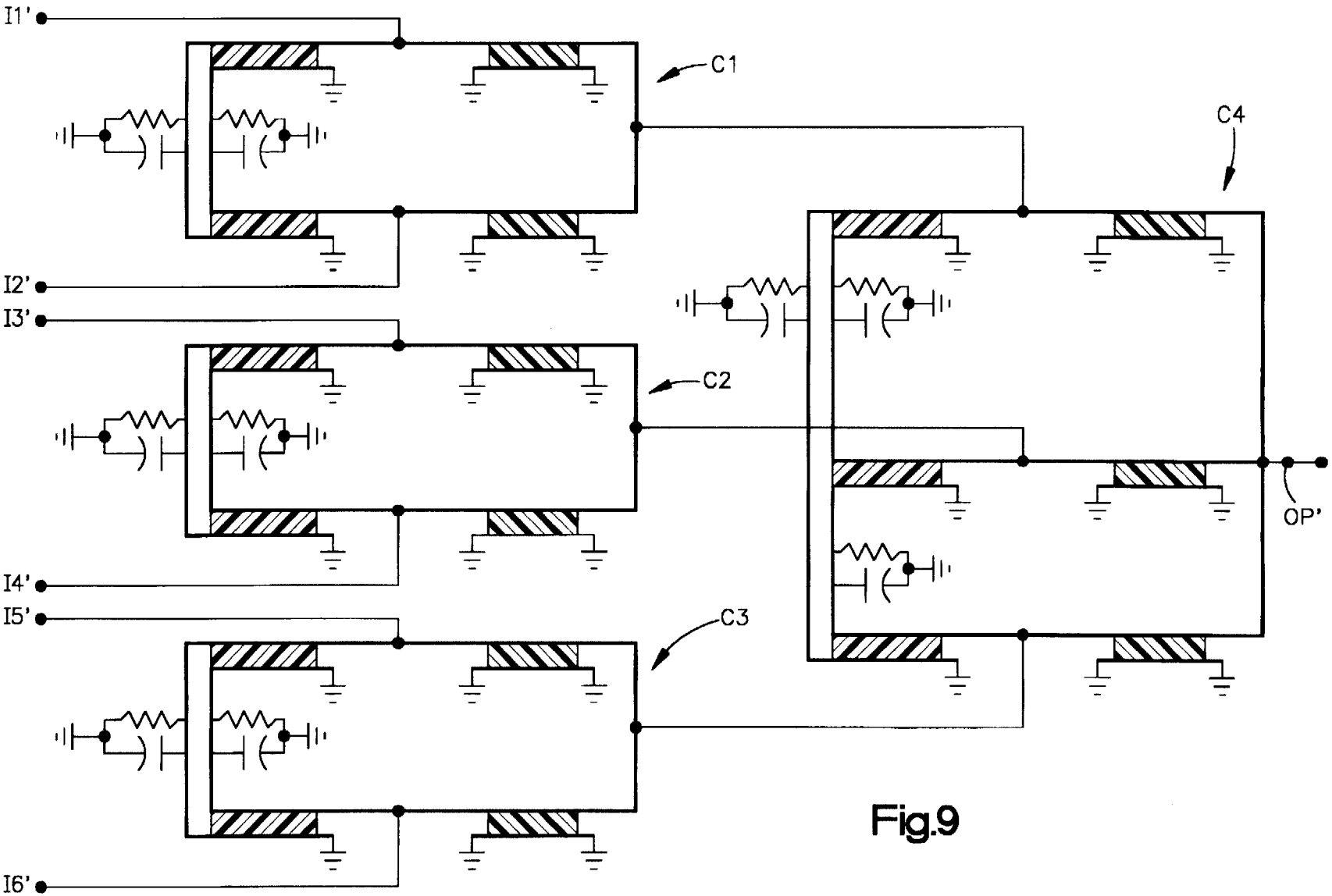
FIG. 9 is a schematic circuit illustration of a transmission line implementation of a third embodiment of the present invention.

Reference is now made to FIG. 9 which illustrates a six-way RF combiner made up of three two-way combiners and one three-way combiner all constructed in the manner as illustrated herein with reference to FIGS. 5 through 8. Thus, this combiner structure includes three two-way combiners C1, C2, and C3. Each combiner has two input ports and an output port. The six input ports I1' to I6' may be connected to six RF power sources. The three output ports from the combiners C1, C2, and C3 are connected to the three input ports of a fourth combiner C4 serving as a three-way combiner and having a single output port OP'.

This six-way combiner may have been constructed as a single stage as opposed to the two stages (three two-way combiners and one three-way combiner) as shown. The two stages provides greater frequency range. A three-way power combiner such as combiner C4 has been optimized and, for example, may cover a frequency range on the order of 470 −650 MHz. The combiners may be made by using microstrip techniques for the ¼ wavelength transmission lines and face-to-face stripline for the balun transformers.

Although, the invention has been described in conjunction with preferred embodiments, it is to be appreciated that various modifications may be made without departing from the spirit and scope of the invention as defined by the appended claims.

Having described the invention, I claim the following:

1. An N-way RF power combiner/divider comprising:

a common output/input port;

N input/output ports;

N isolation ports;

a 90° phase shifting transmission line interconnecting each of said N input/output ports with said common port; and, N transmission line balun transformers, each said transformer interconnecting a said input/output port with one of said N isolation ports.

2. A combiner/divider as set forth in claim 1 wherein N is equal to at least two.

3. A combiner/divider as set forth in claim 1 wherein N is an even or odd integer and is equal to at least two.

4. A combiner/divider as set forth in claim 1 including N isolation loads, each said isolation load being connected between a said isolation port and electrical ground.

5. A combiner/divider as set forth in claim 1 wherein each transmission line has a length equal to ¼ wavelength at the operating frequency of said combiner/divider.

6. A combiner/divider as set forth in claim 1 wherein each said balun transformer is a two-way power splitter having a +90° phase shift output and a −90° phase shift output.

7. A combiner/divider as set forth in claim 6 wherein said 90° phase shift output of one of said power splitter is connected in common with the said −90° phase shift output of another of said splitters.

8. A combiner/divider as set forth in claim 7 wherein said commonly connected −90° phase shift output and said +90° phase shift output are connected in common with one of said N isolation ports.

9. A combiner/divider as set forth in claim 8 including N isolation loads, each said isolation load connecting a said isolation port with electrical ground.

10. An N-way RF power combiner/divider comprising:

a common output/input port;

N input/output ports;

N isolation ports;

a 90° phase shifter interconnecting each of said N input/output ports with said common port; and, N two-way power splitters each having a +90° phase shift output and a −90° phase shift output with the +90° phase shift output of one splitter being connected in common with the −90° phase shift output of another of said splitters and with one of said N isolation ports.

11. A combiner/divider as set forth in claim 10 wherein N is equal to at least two.

12. A combiner/divider as set forth in claim 10 wherein N is an even or odd integer and is equal to at least two.

13. A combiner/divider as set forth in claim 10 including N isolation loads, each said isolation load being connected between a said isolation port and electrical ground.

14. A combiner/divider as set forth in claim 10 wherein each said phase shifter is a transmission line having a length equal to ¼ wavelength at the operating frequency of said combiner/divider.

15. A combiner/divider as set forth in claim 10 wherein each said power splitter is a transmission line balun transformer.

* * * * *